US007666516B2

(12) United States Patent
Nazmy

(10) Patent No.: US 7,666,516 B2
(45) Date of Patent: Feb. 23, 2010

(54) CERAMIC THERMAL BARRIER COATING

(75) Inventor: Mohamed Youssef Nazmy, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/969,257

(22) Filed: Jan. 4, 2008

(65) Prior Publication Data

US 2008/0241560 A1 Oct. 2, 2008

Related U.S. Application Data

(63) Continuation of application No. PCT/EP2006/063826, filed on Jul. 4, 2006.

(30) Foreign Application Priority Data

Jul. 12, 2005 (CH) ..... 1152/05

(51) Int. Cl.
*B32B 9/00* (2006.01)

(52) U.S. Cl. ..... 428/469; 428/472; 428/702; 416/241 B

(58) Field of Classification Search ..... None
See application file for complete search history.

(56) References Cited

U.S. PATENT DOCUMENTS

| | | | |
|---|---|---|---|
| 6,352,788 | B1 | 3/2002 | Bruce |
| 6,544,665 | B2 | 4/2003 | Rigney et al. |
| 7,037,079 | B2 | 5/2006 | Wettstein et al. |
| 7,048,507 | B2 | 5/2006 | Wettstein et al. |
| 7,094,035 | B2 | 8/2006 | Kramer et al. |

(Continued)

FOREIGN PATENT DOCUMENTS

| | | |
|---|---|---|
| EP | 0799904 | 10/1997 |

(Continued)

OTHER PUBLICATIONS

Dong, Z. L., et al., "Microstructure formation in plasma-sprayed functionally graded MiCoCrAlY/yttria-stabilized zirconia coatings," Surface and Coatings Technol., 1999, pp. 181-186, vol. 114, Elsevier Science, Switzerland.

(Continued)

*Primary Examiner*—Timothy M Speer
(74) *Attorney, Agent, or Firm*—Cermak Kenealy Vaidya & Nakajima LLP; Adam J. Cermak

(57) ABSTRACT

A ceramic thermal barrier coating (8) for coating the surface (7) of a component (1) of a nickel-based superalloy, and an adhesive coating optionally applied thereon (6), preferably a gas turbine component, includes zirconium oxide ($ZrO_2$) stabilized by yttrium oxide ($Y_2O_3$) and production-related impurities, as well as at least one high-temperature and oxidation resistant intermetallic compound, for example NiAl, YRh, ErIr, the volume fraction of which decreases continuously or in stages as the distance from the surface (7) of the component (1)/the adhesive coating (6) increases. Advantageously, a less steep stress gradient is produced by gradually varying the composition of the thermal barrier coating (8). This leads to an increased expansion tolerance of the thermal barrier coating (8) and thus, on the one hand, to an increased lifetime under thermal loading (no flaking) and, on the other hand, the possibility of applying thicker thermal barrier coatings (8), and therefore of using the coated components (1) at higher temperatures.

8 Claims, 2 Drawing Sheets

U.S. PATENT DOCUMENTS

2004/0261921 A1 12/2004 Nazmy
2007/0199628 A1 8/2007 Nazmy

FOREIGN PATENT DOCUMENTS

WO WO2007/006681 1/2007

OTHER PUBLICATIONS

Kokini, K., et al., "Thermal shock of functionally graded thermal barrier coatings with similar thermal resistance," Surface and Coatings Technol., 2002, pp. 223-231, vol. 154, Elsevier Science, Switzerland.

Movchan, B. A., "Functionally graded EB PVD," Surface and Coatings Technol., 2002, pp. 252-262, vol. 149, Elsevier Science, Switzerland.

Shen, P., et al., "Alloying Behaviour of Ni2AlTi and NiAl in Yttria-Partially Stabilized Zirconia," Mat. Sci. Eng., 1988, pp. 177-185, vol. 100, Elsevier Sequoia, Netherlands.

Song, Y-S., et al., "High-temperature properties of plasma-sprayed coatings of YSZ/NiCrAlY on Inconel substrate," Mat. Sci. Eng., 2002, pp. 129-133, vol. A332, Elsevier Science, Switzerland.

Search Report for Swiss Patent App. No. 1152/2005 (Apr. 25, 2006).

International Search Report for PCT Patent App. No. PCT/EP2006/063826 (Sep. 25, 2006).

CERAMIC THERMAL BARRIER COATING

This application is a Continuation of, and claims priority under 35 U.S.C. § 120 to, International application number PCT/EP2006/063826, filed 4 Jul. 2006, and claims priority therethrough under 35 U.S.C. § 119 to Swiss application number 01152/05, filed 12 Jul. 2005, the entireties of which are incorporated by reference herein.

BACKGROUND

1. Field of Endeavour

The invention concerns the field of materials technology. It relates to a ceramic thermal barrier coating which is used to coat heavily thermally loaded components, for example rotor blades of a gas turbine.

2. Brief Discussion of Related Art

In order to increase the efficiency of gas turbines, they are run at very high operating temperatures. The components exposed to the hot gases, for example guide vanes and rotor blades or combustion chamber elements, are therefore provided in a known way with thermal barrier coatings (TBC) on their surface in order to achieve higher operating temperatures and/or extend the lifetime of the components. These thermal barrier coatings conventionally consist of a ceramic material, usually of zirconium oxide ($ZrO_2$) stabilized by yttrium oxide ($Y_2O_3$), which is applied onto the surface of components often consisting of nickel-based superalloys. In order to improve the bonding of the ceramic coating on the component, adhesive coatings of MCrAlY are often provided between the thermal barrier coating and the surface of the component, where M stands for a metal, specifically for Ni, Fe, Co, or combinations thereof.

It is known to spray the TBC on thermally. Possible methods known for applying these coatings are plasma spraying, for example air plasma spraying (APS), low-pressure plasma spraying (LPPS), vacuum plasma spraying (VPS) or flame spraying, for example high velocity flame spraying (high velocity oxygen fuel HVOF), as well as physical vapor deposition (PVD), for example by means of an electron beam (electron beam physical vapor deposition EB-PVD) (see, for example, U.S. Pat. Nos. 6,352,788 B2 and 6,544,665 B2).

With the aid of EB-PVD, columnar coatings are produced which have an expansion-tolerant grain structure that is capable of expanding or contracting under different loads so that no stresses are generated, which would lead, for example, to flaking of the coatings. The high costs, however, are a disadvantage of this method.

In contrast to this, APS-sprayed TBCs for example have a high degree of inhomogeneities and porosity, which advantageously reduces the heat transfer through the TBC. During operation of a gas turbine, however, the thermal conductivity increases owing to structural modifications, for example grain growth, so that countermeasures need to be implemented in order to achieve sufficient thermal protection. One of these countermeasures, for example, is to spray thicker coatings. Disadvantageously, this is, on the one hand, very expensive and, on the other hand, often not practically feasible. Conventional TBC coating thicknesses are approximately 250-300 μm.

U.S. Pat. No. 6,544,665 B2 therefore proposes to introduce for example $Al_2O_3$ (at least 0.1-3 mol. %) into the microstructure of the TBC. The $Al_2O_3$ does not bond with the matrix of the ceramic coating; rather, it forms dislocations and therefore prevents the grain growth. This does not, however, have a positive effect on the stress gradients and therefore on reducing the flaking risk of the TBC.

SUMMARY

One of numerous aspects of the invention includes an improved ceramic thermal barrier coating based on zirconium oxide ($ZrO_2$) stabilized by yttrium oxide ($Y_2O_3$) for coating a component made of a nickel-based superalloy, which is distinguished by a long lifetime as well as high oxidation resistance and ductility.

Another aspect of the invention includes that the thermal barrier coating based on zirconium oxide ($ZrO_2$) stabilized by yttrium oxide ($Y_2O_3$) also includes, besides production-related impurities, at least one high-temperature and oxidation resistant intermetallic compound, the volume fraction of which decreases continuously or in stages, preferably in an exponential or linear form, as the distance from the surface of the nickel-based superalloy increases.

Another aspect of the invention includes a method for applying the described thermal barrier coating onto a surface of a component, consisting of a nickel-based superalloy and a metallic adhesive coating optionally applied thereon, in which a) ceramic powder of zirconium oxide ($ZrO_2$) stabilized by yttrium oxide ($Y_2O_3$) and powder of at least one intermetallic compound are mixed together, b) this powder mixture is subsequently sprayed by means of known thermal spraying methods either directly onto the surface of the component or, when a metallic adhesive coating is present, directly onto the metallic adhesive coating, c) method steps a) and b) are repeated several times, the powder mixture each time having a lower volume fraction of intermetallic compound than in the previous method step, and the powder mixture in each case being sprayed onto the coating already sprayed on in the previous method step, so that a thermal barrier coating is finally formed with a volume fraction of intermetallic compounds decreasing over the coating thickness.

Advantageously, a less steep stress gradient can be produced by gradually varying the composition of the thermal barrier coating as a function of the thickness of the thermal barrier coating. This leads to an increased expansion tolerance of the TBC coating and thus, on the one hand, to an increased lifetime under thermal loading (no flaking) and, on the other hand, the possibility of applying thicker thermal barrier coatings, and therefore of using the coated components at higher temperatures.

It is expedient for NiAl, alloyed NiAl, YRh, or ErIr to be used as an intermetallic compounds. These intermetallic compounds are oxidation-resistant and have sufficient ductility in a large temperature range. They furthermore have only a minor tendency to interdiffusion and have a high melting point.

It is advantageous for the volume fraction of the intermetallic compound in the coating to be approximately 80% on the surface of the component and approximately 5% on the free surface.

BRIEF DESCRIPTION OF THE DRAWINGS

An exemplary embodiment of the invention is represented in the drawing, in which.

Only the features essential to the invention are represented. Elements which are the same have the same references in different figures.

DETAILED DESCRIPTION OF EXEMPLARY EMBODIMENTS

The invention will be explained in more detail below with the aid of an exemplary embodiment.

Coatings and methods embodying principles of the present invention may be employed for all components which are exposed to high temperatures and oxidative/corrosive environmental effects, for example blades, hot-spot segments, or parts of the combustion chambers of gas turbines.

Figure 1:
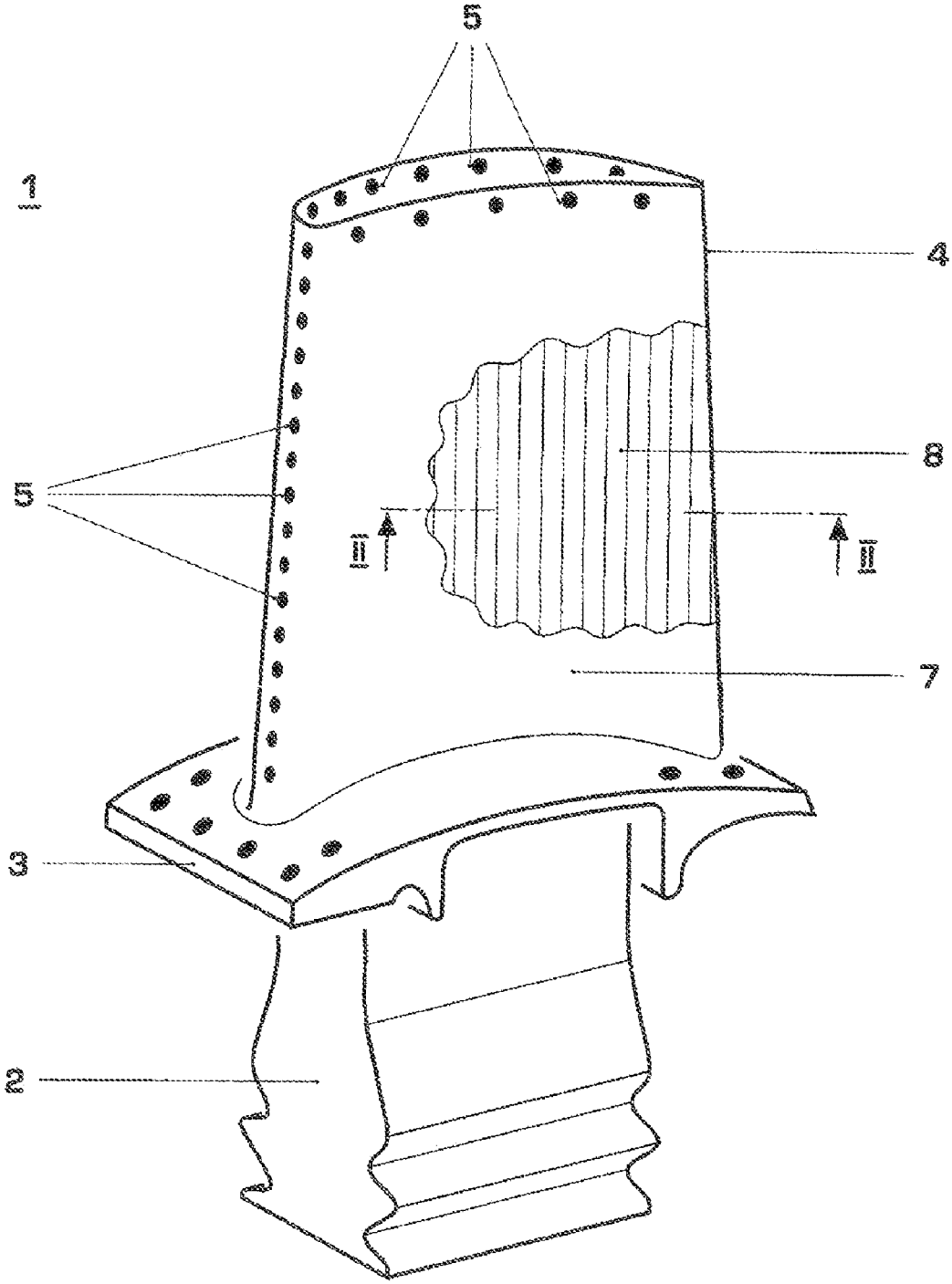
FIG. 1 shows a perspective representation of a rotor blade of a gas turbine.

FIG. 1 shows a rotor blade of a gas turbine in perspective representation as an example of such components 1. The rotor blade 1 includes a blade root 2, a platform 3, and a blade body 4 which contains cooling air channels, the openings of which are denoted by 5 in FIG. 1. The rotor blade 1 is anchored by its blade root 2 into circumferential grooves in the rotor (not shown) of the gas turbine. During operation of the turbine, the blade body 4 is exposed to hot combustion gases so that the surface 7 of the blade body 4 is subjected both to the hot combustion gases and to attacks by oxidation, corrosion, and erosion. In order to protect against oxidation/corrosion as well as for high thermal loading, the blade body 4 is therefore provided on its outer surface 7 with a metallic adhesive coating 6 (not visible in FIG. 1), onto which a ceramic thermal barrier coating 8 is sprayed.

Figure 2:
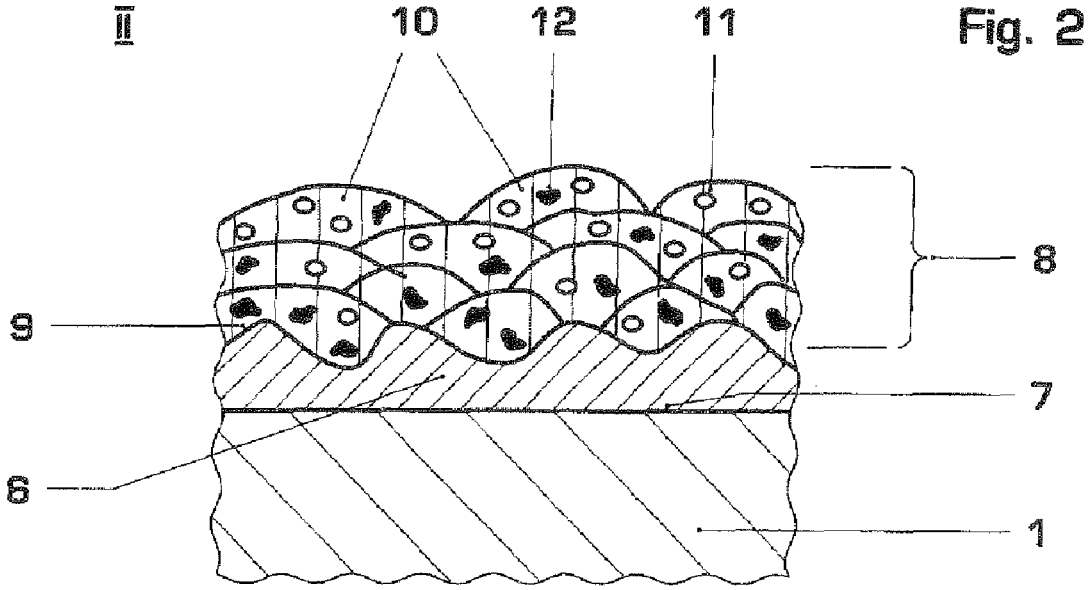
FIG. 2 shows a section along the line II-II in FIG. 1.

The coating system can be seen clearly in the sectional representation according to FIG. 2. The base material of the rotor blade 1 of the gas turbine consists, for example, of a directionally solidified nickel-based superalloy CM 247 with the following chemical composition (data in wt. %):=0.07 C, 8.1 Cr, 9.2 Cr, 0.5 Mo, 9.5 W, 3.2 Ta, 5.6 A 0.7 Ti, 0.015 B, 0.015 Zr, 1.4 Hf, remainder Ni.

In another exemplary embodiment, the turbine blade may preferably consist of a monocrystalline alloy, for example with the following chemical composition (data in wt. %):=7.7-8.3 Cr, 5.0-5.25 Co, 2.0-2.1 Mo, 7.8-8.3 W, 5.8-6.1 Ta, 4.9-5.1 Al, 1.3-1.4 Ti, 0.11-0.15 Si, 0.11-0.15 Hf, 200-750 ppm C, 50-400 ppm B, remainder nickel and production-related impurities.

These base materials (substrates) are provided on their outer surface 7 with a metallic adhesive coating 6, preferably of the MCrAlY type, where M stands for a metal (Ni, Fe, Co, or combinations thereof). In the present case, NiCrAlY was used for the adhesive coating 6. The Al-rich adhesive coatings of this type form an $Al_2O_3$ scale coating 9, which is formed by thermal oxidation of the adhesive coating 6. This $Al_2O_3$ coating 9 binds the ceramic thermal barrier coating onto the adhesive coating 6 and the substrate (nickel-based superalloy).

The TBC 8 is formed of zirconium oxide ($ZrO_2$) stabilized by yttrium oxide ($Y_2O_3$), there being about 7% yttrium oxide. The thermal barrier coating 8 is sprayed on by means of known thermal spraying methods, for example by means of APS. To this end, according to principles of the invention, the ceramic powder is initially mixed with powder of an intermetallic compound 12, in the present exemplary embodiment nickel aluminide NiAl, and this powder mixture is subsequently sprayed thermally onto the adhesive coating 6. In the first method step, the volume fraction of the intermetallic compound 12 is very high, here 80 vol. %. The two method steps are now repeated several times, the powder mixture each time having a lower volume fraction of the intermetallic compound NiAl than in the previous method step, and the powder mixture in each case being sprayed onto the coating already sprayed on in the previous method step, so that a thermal barrier coating 8 is finally formed with a volume fraction of intermetallic compound 12 decreasing over the coating thickness. Finally, there are only approximately 5 vol. % of NiAl on the surface of the fully coated component 1.

Figure 3:
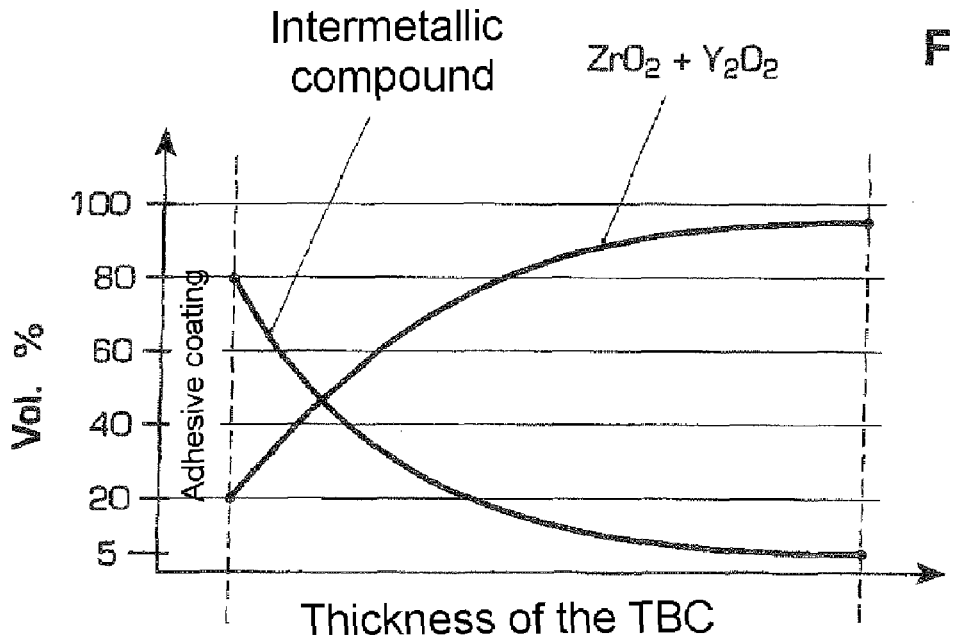
FIG. 3 shows a schematic profile of the volume fractions in the TBC as a function of the distance from the base substrate.

This is represented in FIG. 3, where the schematic profile of the volume fractions of intermetallic compounds 12 and zirconium oxide ($ZrO_2$) stabilized by yttrium oxide ($Y_2O_3$) in the thermal barrier coating 8 are respectively shown as a function of the distance from the adhesive coating 6, i.e., as a function of the thickness of the thermal barrier coating 8. The volume fraction of intermetallic compound 12 continuously decreases exponentially here. In other exemplary embodiments, it may also decrease linearly or in stages.

It is known that the ceramic thermal barrier coatings produced by APS consist of single grains and have a relatively coarse porosity. In FIG. 2, these grains are denoted by the reference 10 and the pores are denoted by the reference 11. In the thermal barrier coating 8 embodying principles of the present invention, the intermetallic compound 12, here NiAl, accumulates preferentially in these pores 11. The intermetallic compounds, for example nickel aluminide, are oxidation-resistant and have sufficient ductility in a large temperature range. They furthermore have only a low tendency to interdiffusion and have a high melting point. By gradually modifying the composition of the thermal barrier coating as a function of the thickness of the thermal barrier coating, a less steep stress gradient is advantageously generated in the coating. This leads to an increased expansion tolerance of the thermal barrier coating and thus, on the one hand, to an increased lifetime under thermal loading and, on the other hand, the possibility of applying thicker thermal barrier coatings, and therefore of using the coated components at higher temperatures.

While coating thicknesses of approximately 250-300 μm can be sprayed by APS in the case of conventional yttrium oxide-stabilized zirconium oxide thermal barrier coatings, coating thicknesses of up to approximately 2 mm are readily feasible in the method described herein.

The invention is of course not restricted to the exemplary embodiment which has been described. Besides the aforementioned NiAl, the following intermetallic compounds are also suitable for achieving the advantages according to the invention: YRh, ErIr, and alloyed NiAl, since these intermetallic compounds are oxidation-resistant, have good ductility in all temperature ranges, and also have a low tendency to interdiffusion and high melting points. A less steep stress gradient is achieved owing to the steady graduation of the volume fraction of intermetallic compound, so that the thermal barrier coating is substantially more expansion-tolerant and therefore has a longer lifetime under thermal loading.

The thermal barrier coatings described herein may also be applied onto other heavily thermally loaded gas turbine components, for example heat shields or combustion chamber liners, in which case the base material of the component may, for example, be Hastalloy or Haynes 230, and the adhesive coating may, for example, be an NiCoCrAlY coating.

Lastly, spraying methods other than APS are also suitable for thermally spraying the TBC according to the present invention, for example EB-PVD. The thermal barrier coatings thereby produced are rod-shaped.

It is of course also possible to spray the TBC directly onto the surface of the component, i.e., without an additional adhesive coating.

LIST OF REFERENCES

1 component, for example rotor blade
2 blade foot
3 platform
4 blade body
5 openings of the cooling air channels
6 adhesive coating
7 surface of the component
8 thermal barrier coating, TBC
9 Al2O3 coating
10 grain
11 pore
12 intermetallic compound While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A ceramic thermal barrier coating useful for coating the surface of a component, the thermal barrier coating comprising an inner surface for positioning adjacent to an external surface of said component, and an outer surface, and formed of zirconium oxide ($ZrO_2$) stabilized by yttrium oxide ($Y_2O_3$) and production-related impurities, and at least one intermetallic compound selected from the group consisting of NiAl, alloyed NiAl, YRh, and ErIr, the volume fraction of said intermetallic compound decreasing as the distance from the inner surface increases.

2. The thermal barrier coating as claimed in claim 1, wherein the volume fraction of said intermetallic compound decreases continuously as the distance from the inner surface increases.

3. The thermal barrier coating as claimed in claim 1, wherein the volume fraction of said intermetallic compound decreases in stages as the distance from the inner surface increases.

4. The thermal barrier coating as claimed in claim 1, wherein the volume fraction of said intermetallic compound decreases exponentially as the distance from the inner surface increases.

5. The thermal barrier coating as claimed in claim 1, wherein the volume fraction of said intermetallic compound decreases linearly as the distance from the inner surface increases.

6. The thermal barrier coating as claimed in claim 1, wherein the volume fraction of said intermetallic compound is approximately 80% at the inner surface and approximately 5% on the thermal barrier coating outer surface.

7. A gas turbine component comprising:

a component formed of a nickel-based superalloy and having an external surface; and a thermal barrier coating according to claim 1 outside of the component external surface.

8. A gas turbine component according to claim 7, further comprising:

an adhesive coating between the component external surface and the thermal barrier coating.

* * * * *